US008899218B2

(12) United States Patent
Kempf

(10) Patent No.: US 8,899,218 B2
(45) Date of Patent: Dec. 2, 2014

(54) SHOOTING BOW

(71) Applicant: James J. Kempf, Coralville, IA (US)

(72) Inventor: James J. Kempf, Coralville, IA (US)

( * ) Notice: Subject to any disclaimer, the term of this patent is extended or adjusted under 35 U.S.C. 154(b) by 211 days.

(21) Appl. No.: 13/622,744

(22) Filed: Sep. 19, 2012

(65) Prior Publication Data

US 2014/0076296 A1 Mar. 20, 2014

(51) Int. Cl.
*F41B 5/18* (2006.01)

(52) U.S. Cl.
USPC ..... 124/35.1

(58) Field of Classification Search
USPC ..... 124/25, 31, 35.1
See application file for complete search history.

(56) References Cited

U.S. PATENT DOCUMENTS

| | | | |
|---|---|---|---|
| 3,238,935 | A | 3/1966 | Stanaland |
| 4,030,473 | A | 6/1977 | Puryear |
| 4,192,281 | A | 3/1980 | King |
| 2,957,470 | A | 10/1980 | Bama |
| 4,722,317 | A | 2/1988 | Hartwig |
| 4,766,874 | A | 8/1988 | Nishioka |
| 4,877,008 | A | 10/1989 | Troubridge |
| 4,879,987 | A | 11/1989 | Nishioka |
| 4,976,250 | A | 12/1990 | Jeffrey |
| 5,025,771 | A | 6/1991 | Hanson |
| 5,085,200 | A | 2/1992 | Horton-Corcoran et al. |
| 5,115,795 | A | 5/1992 | Farris |
| 5,215,069 | A | 6/1993 | Liu |
| 5,368,006 | A | 11/1994 | McPherson |
| 5,546,924 | A | 8/1996 | Todd |
| 5,596,976 | A | 1/1997 | Waiser |
| 5,598,829 | A | 2/1997 | Bednar |
| 5,630,405 | A | 5/1997 | Nizov |
| 5,649,520 | A | 7/1997 | Bednar |
| 5,884,614 | A | 3/1999 | Darlington et al. |
| 6,155,243 | A | 12/2000 | Gallops, Jr. |
| 6,205,990 | B1 | 3/2001 | Adkins |
| 6,267,108 | B1 | 7/2001 | McPherson et al. |
| 6,460,528 | B1 | 10/2002 | Gallops, Jr. |
| 6,651,642 | B1 | 11/2003 | Powers |
| 6,802,304 | B1 | 10/2004 | Chang |
| 7,174,884 | B2 | 2/2007 | Kempf |
| 7,726,291 | B2 | 6/2010 | Pedermonte |
| 7,743,543 | B2 | 6/2010 | Karagias |
| 7,770,567 | B1 | 8/2010 | Yehle |
| 2005/0072415 | A1 | 4/2005 | Schavone |

*Primary Examiner* — Gene Kim
*Assistant Examiner* — Amir Klayman
(74) *Attorney, Agent, or Firm* — Brett J. Trout P.C.

(57) ABSTRACT

A trigger assembly for a crossbow or other weapon system. The trigger assembly includes a trigger arm coupled between a trigger and a sear. The trigger arm is not parallel to the line of fire, thereby allowing for increased mechanical advantage and a smoother, safer trigger pull. The trigger assembly incorporates various safety measures, including a dry fire mechanism which prevents the unintentional damaging and potentially dangerous release of the bowstring before an arrow is positioned on the rail of the crossbow. The trigger assembly allows for various adjustments to vary the trigger length and pull, while maintaining smoothness and preventing the unintentional or inadvertent release of the bowstring.

15 Claims, 7 Drawing Sheets

SHOOTING BOW

BACKGROUND OF THE INVENTION

1. Field of the Invention

The present invention relates in general to a trigger assembly and, more particularly, to an adjustable trigger assembly for use in association with a crossbow.

2. Description of the Prior Art

Crossbows have been known for centuries. By allowing the shooter to mechanically retain the bow in a cocked position, the shooter is provided an advantage over a traditional archer who must utilize muscular force to retain the bow in the cocked position. In a typical crossbow assembly, a cocking mechanism is utilized whereby two hooks are applied to the bowstring to draw the bowstring rearward into engagement with a retainer pin or other device utilized to retain the bowstring in the cocked position until the trigger is pulled.

As crossbows typically utilize very strong limbs, the bowstring is under high tension. This tension requires firm engagement between the sear and the trigger assembly. Tension associated with prior art devices and the solid engagement of the sear with the trigger assembly often results in an undesirably hard and rough trigger pull. This tension associated with many prior art devices may also result in torsion of the trigger assembly, causing unanticipated early or late release of the string during the trigger pull. It would, therefore, be desirable to provide a trigger assembly which provided sufficient mechanical advantage and stability to allow for a comfortable, smooth and predictable lightweight trigger pull to maintain comfort and prevent unintentional launch of a projectile from the crossbow associated with torsion forces on the trigger. The difficulties encountered in the prior art discussed hereinabove are substantially eliminated by the present invention.

SUMMARY OF THE INVENTION

In an advantage provided by this invention, a trigger assembly is provided which allows for safer actuation of a firing assembly.

Advantageously, this invention provides an alternative trigger assembly which allows for mechanical advantage to reduce trigger pull.

Advantageously, this invention provides a trigger assembly which may be adjusted for trigger travel and trigger pull.

Advantageously, this invention provides a trigger assembly with improved dry fire characteristics.

Advantageously, this invention provides a trigger assembly which increases trigger pull comfort.

Advantageously, this invention provides a trigger assembly which reduces inadvertent actuation of a firing mechanism during trigger pull.

Advantageously, this invention provides a trigger assembly which is of a low-cost, efficient manufacture.

Advantageously, in the preferred embodiment of this invention, a trigger assembly is provided with a trigger journaled to a frame defining a projectile path. A trigger arm is coupled between the trigger and a sear. A sear is coupled to a firing assembly. The trigger arm is not parallel with the projectile path. Preferably, the connection point of the trigger arm to the trigger bar is adjustable to change the trigger draw length and pull.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
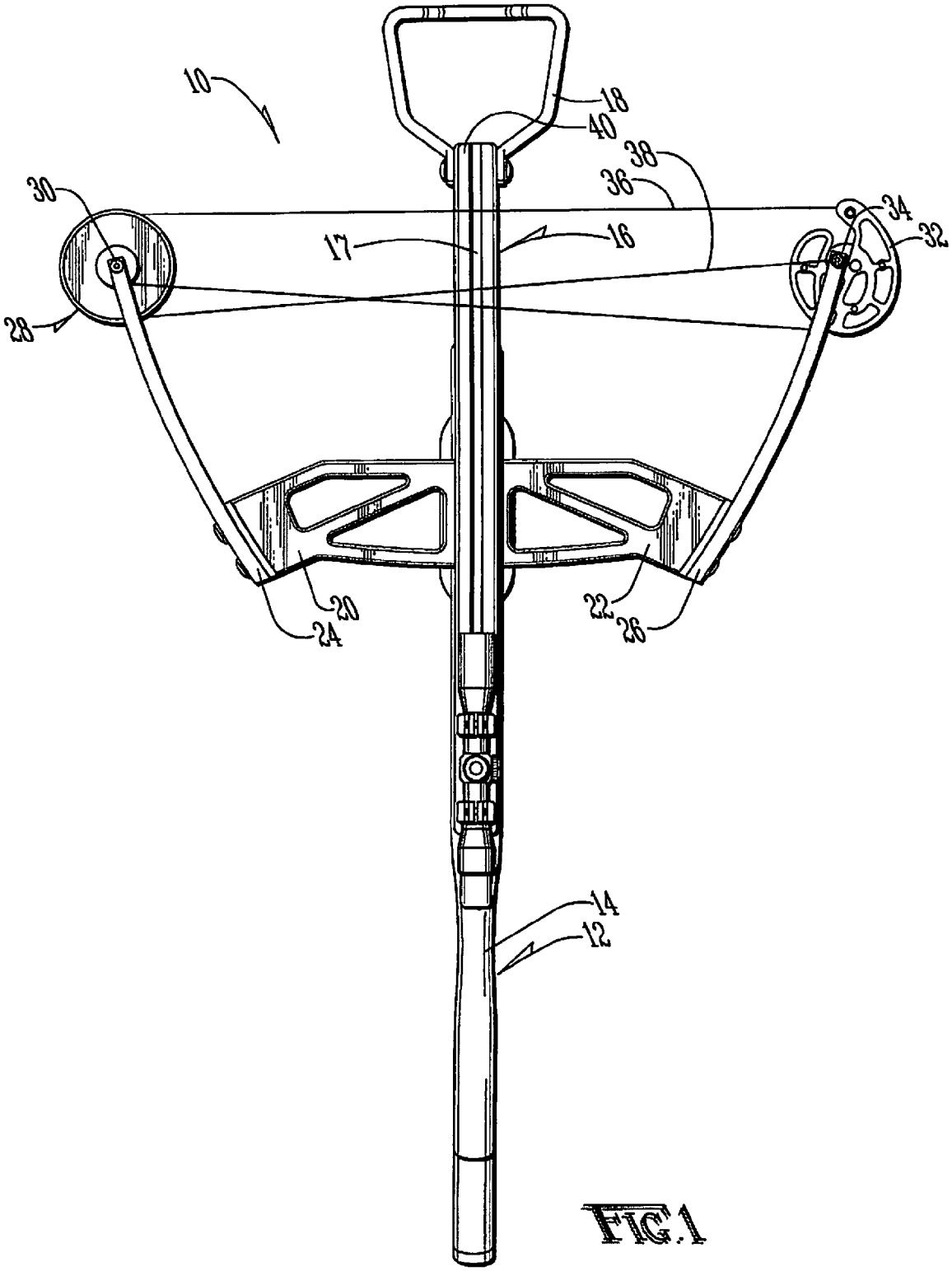
FIG. 1 shows a top plan view of a crossbow incorporating the trigger assembly of the present invention.

A crossbow is shown generally as (10) in FIG. 1. The crossbow (10) is provided with a frame (12) which includes a stock (14) and a rail (16) defining a projectile path (17). Although the stock (14) and rail (16) may be of any type known in the art, in the preferred embodiment the stock (14) is of a composite material construction and the rail (16) is constructed of aluminum. Alternatively, the crossbow (10) may be of a "railless" design, such as those known in the art.

The crossbow (10) is provided with a pivotable foot stirrup (18) to facilitate cocking of the crossbow (10). As shown in FIG. 1, the crossbow (10) is also provided with a pair of risers (20) and (22) secured to the rail (16). The risers (20) and (22) are preferably constructed of aluminum to reduce weight.

Coupled to the risers (20) and (22) are limbs (24) and (26). The limbs (24) and (26) are constructed and coupled to the risers (20) and (22) in a manner such as that known in the art. Coupled to the first limb (24) is a first string guide, which in the preferred embodiment is a pulley (28). The pulley (28) is preferably journaled to end of the limb (24) by an axle (30). The pulley (28) is preferably journaled to the limb (24) in a manner which positions a portion of the pulley (28) forward and outward of the space defined between the limbs (24) and (26).

Figure 3:
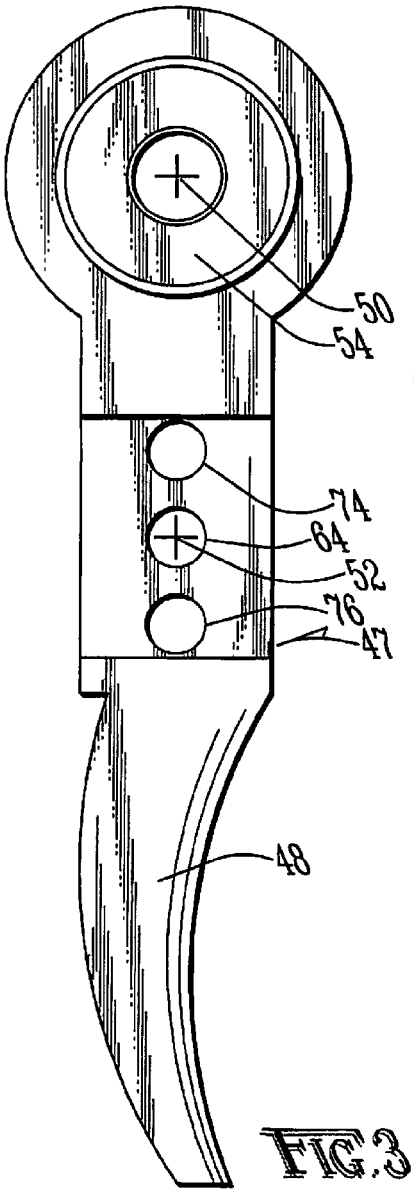
FIG. 3 illustrates a side elevation of an alternative trigger bar of the present invention, shown with the bearing, the trigger arm attachment and the trigger.

As shown in FIG. 1, a second string guide, which in the preferred embodiment is a cam (32), is journaled to the second limb (26) by an axle (34). The cam (32) is also journaled to the second limb (26) so that at least a portion of the cam (32) extends forward and outward of the area defined between the limbs (24) and (26). The cam (32) is preferably constructed as shown in FIG. 3, but may be constructed in a manner known in the art.

If desired, two synchronized cams (not shown) may be used in place of the cam (32) and pulley (28). The cam (32) and pulley (28) are coupled to a bowstring (36) and, if desired, one or more cables (38) in a manner known in the art. The bowstring (36) is preferably located as shown in FIG. 1, forward of the points on the limbs (24) and (26) where the cam (32) and pulley (28) are journaled to the limbs (24) and (26).

As shown in FIG. 1, the foregoing orientation of the pulley (28), cam (32), cable (38) and bowstring (36) positions the bowstring (36) very close to the forward end (40) of the rail (16).

Figure 2:
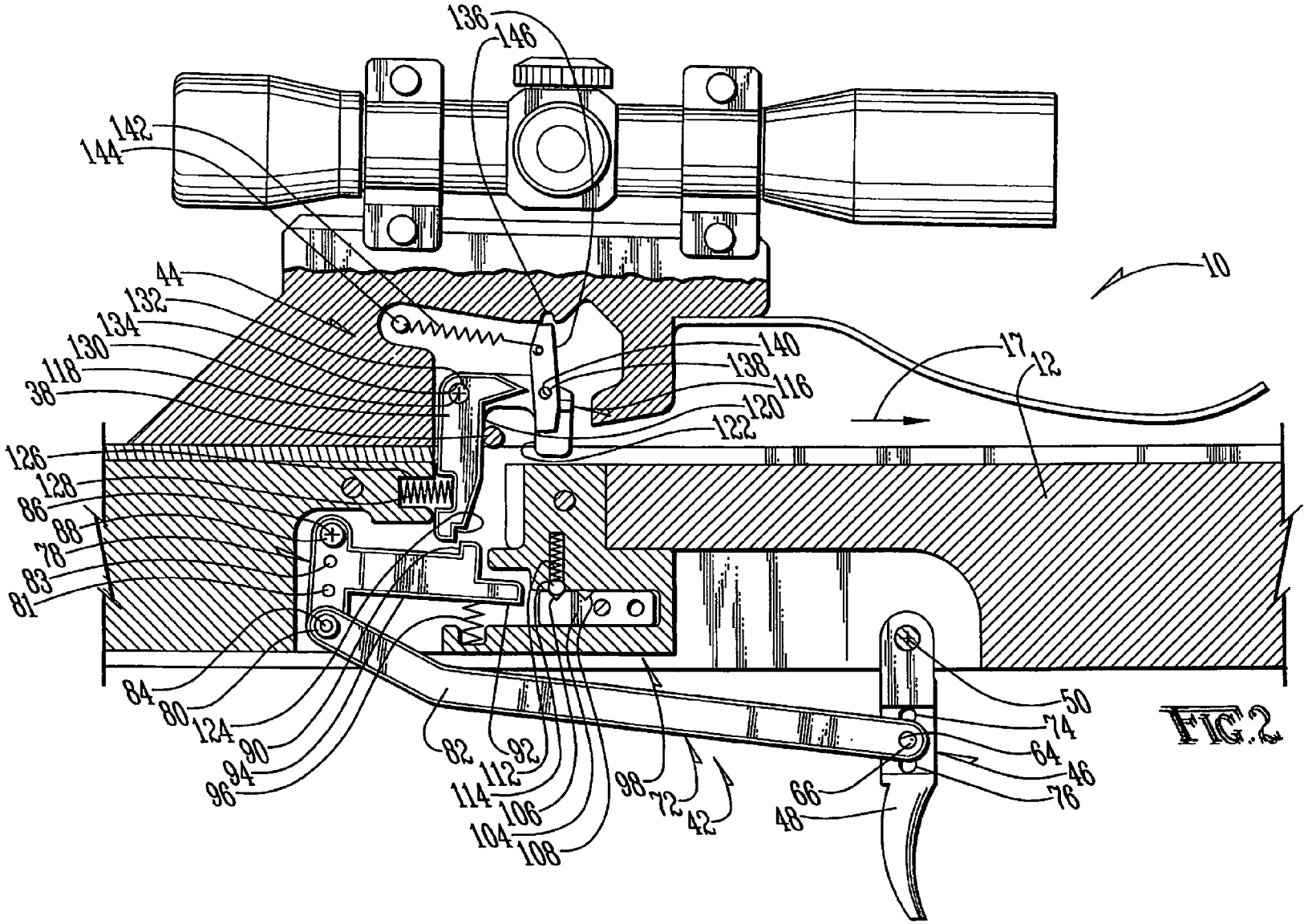
FIG. 2 illustrates a side elevation in cross-section of the trigger assembly of the present invention, shown with the string engaging the string engager.
Figure 4:
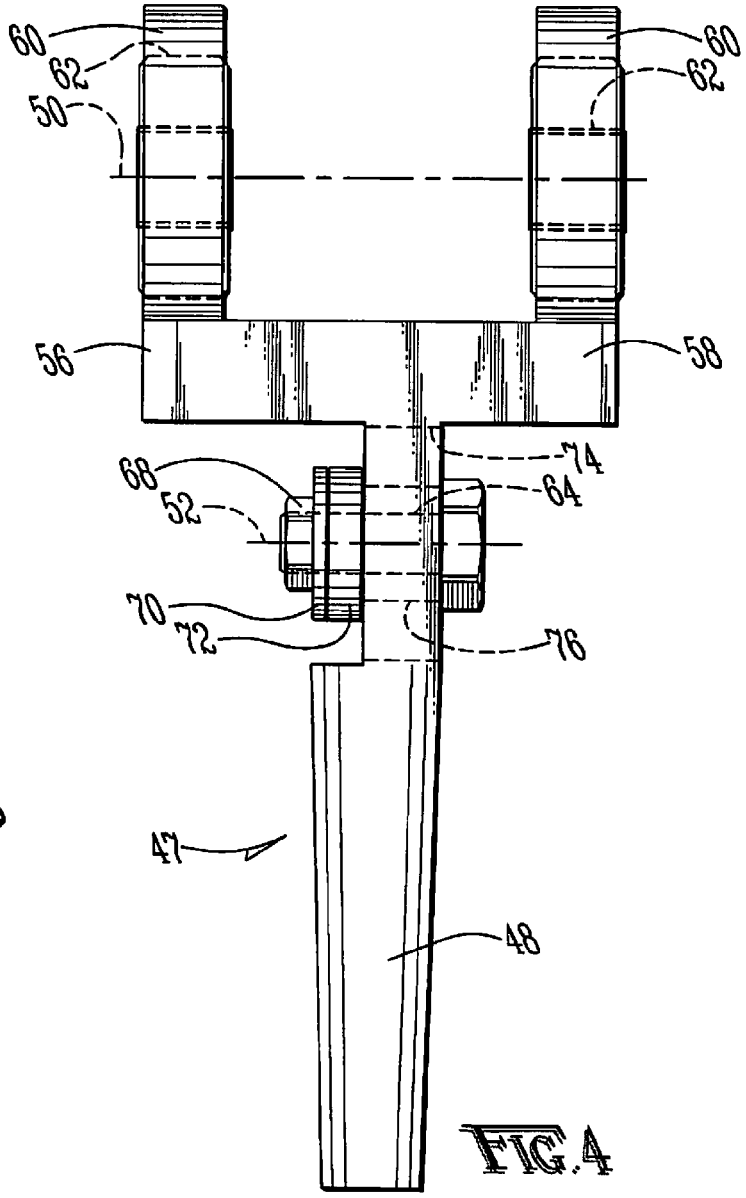
FIG. 4 illustrates a rear elevation in partial phantom of the trigger bar, showing the trigger arm attachment point, the first shoulder and second shoulder, and the trigger.

As shown in FIG. 2, the trigger assembly is shown generally as (42) which includes a firing assembly shown generally as (44). As shown in FIG. 3, the trigger bar (46) is integrally formed of a single piece of hardened steel defining a trigger (48), a trigger bar pivot point or axis (50) and a trigger arm pivot point or axis (52). The trigger bar pivot point or axis (50) is surrounded by a bearing (54). (FIG. 2). While the trigger bar (46) is preferably a single bar, an alternative trigger bar (47) is shown in FIG. 4. The alternative trigger bar (47) defines a shoulder (56) coupling a first arm (58) to a second arm (60). The first arm (58) and the second arm (60) are provided with bearings (62) concentric around the trigger bar pivot axis (50). The arms (58) and (60) are preferably positioned at least one centimeter apart and, more preferably, at least two centimeters apart to reduce torsion of the trigger bar (46) when the trigger (48) is pulled, thereby reducing the likelihood of inadvertent actuation of the firing assembly (44).

Like the preferred trigger bar (46), the alternative trigger bar (47) is provided with an opening (64) concentric around the trigger arm pivot axis (52). Provided within the opening (64) is a bolt (66) provided with a nut (68) and washer (70). Provided between the washer (70) and the trigger bar (46) is a trigger arm (72).

As shown in FIG. 4, in the preferred embodiment the trigger bar (46) is provided with additional openings (74) and (76) to accommodate the bolt (66), nut (68) and washer (70) assembly to increase or decrease the length and weight of the trigger pull. It should be noted that any desired number and placement of openings may be provided.

As shown in FIG. 2, the trigger arm (72) is coupled on one end to the trigger bar (46) as described above and on its opposite end at a connection (80). The trigger arm (72) is not parallel to the rail (16) or direction of firing, and is preferably provided with a bend (82) which may be configured as desired to provide the desired length and weight of trigger pull. Additionally, alternate trigger arms (72) with bends (82)of various degrees may be substituted to adjust the length and weight of the trigger pull as desired. In the preferred embodiment, the trigger pull is between 0.25 pound and 5.0 pounds, more preferably between 1.5 pounds and 3.5 pounds and, most preferably, between 2.0 and 3.0 pounds.

The sear assembly (78) is journaled to the frame (12). The trigger arm (72) is coupled to the sear assembly (78) by a releasable fastener provided at one of various connection points (80), (81) and (83). While the fastener may be of any type known in the art, preferably the fastener is a bolt (84) which journals the trigger arm (72) to the sear assembly at the connection point (80).

The sear assembly (78) is journaled to the frame (12) at a sear pivot axis (86). The sear assembly (78) may be secured with a steel pin (88) provided through the sear assembly (78) and secured to the frame (12), or by any other journaling means known in the art.

As shown in FIG. 2, as shown in FIG. 2, the sear assembly (78) is provided with a sear face (90) and safety engager (92). Secured to the lower edge (94) of the sear assembly (78) is a compression spring (96) which is also secured to the frame (12).

Provided forward of the sear assembly (78) is the safety assembly (98). The safety assembly (98) includes a steel safety block (100) defining a slot (102). Provided within the slot (102) is a steel safety bar (104) provided with two detents (106) and (108). Provided in the safety block (100) is a shaft (110) housing a compression spring (112), coupled to a ball (114) at the opening of he shaft (110). The ball (114) is configured to fit into the detents (106) and (108) to maintain the safety bar (104) in either the safe or fire positions.

Provided above the sear assembly (78) is the string retention assembly (116). The string retention assembly (116) includes a generally U-shaped retainer bar (118) defining a string engager (120) and a string retainer (122). The retainer bar (118) includes a sear engager (124) which is a generally flat face provided in the retainer bar (118). The frame (12) is provided with a cylindrical slot (126) within which is provided a compression spring (128) in contact with the retainer bar (118) and biasing the retainer bar (118) toward a counter-clockwise rotation around a retainer bar pivot axis (130). Provided along the retainer bar pivot axis (130) is a stainless steel pin (132) coupled to the frame (12) and journaled through a slot (134) provided in the retainer bar (118).

Journaled to the retainer bar (118) is a dry fire pin (136) which pivots on a pin (138) provided through a slot (142) in the retainer bar (118). An extension spring (142) is coupled between a post (144) coupled to the frame (12) and the dry fire pin (136), biasing the dry fire pin (136) into a counter-clockwise rotation into a "no fire" position where the dry fire pin (136) engages a recess (146) provided in the frame (12).

Figure 5:
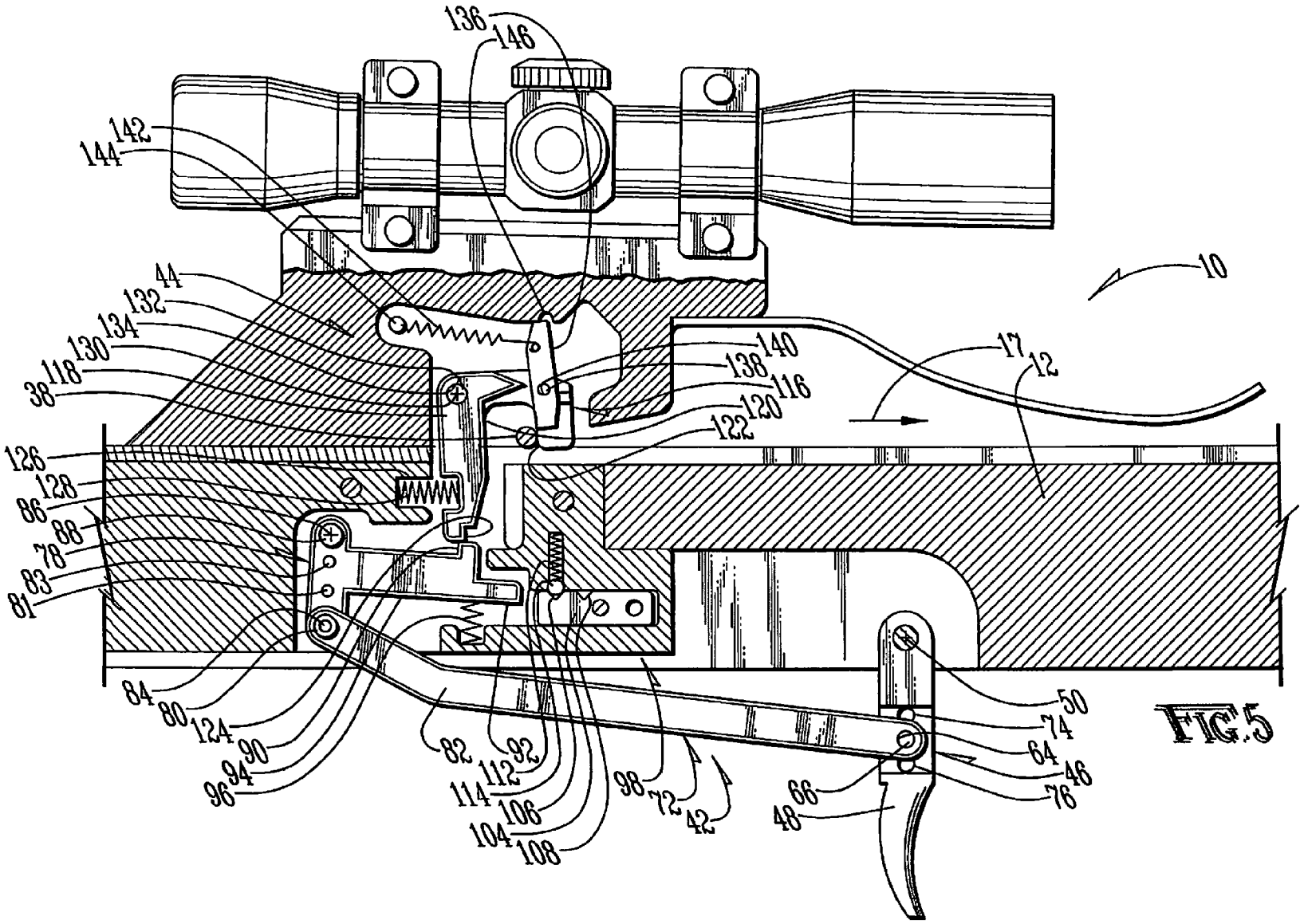
FIG. 5 shows a side elevation in cross-section of the trigger assembly of FIG. 2, shown with the string engaging the string retainer and actuating the dry fire mechanism.

When it is desired to utilize the trigger assembly (42) of the present invention, the trigger (48) is adjusted as desired, utilizing the desired trigger arm (72), having the desired bend (82) and provided within the desired opening (64), (74) or (76) of the trigger bar (46). Once the desired trigger length and pull has been set, the bowstring (36) is pulled rearward toward the retainer bar (118). The compression spring (128) biases the retainer bar (118) in a counter-clockwise rotation, providing sufficient space below the string retainer (122) to allow passage of the string (36). The bowstring (36) is pulled rearward into engagement with the string engager (120) until the bowstring (36) rotates the retainer bar (118) clockwise sufficiently to compress the compression spring (128). This allows the compression spring (96) to force the sear assembly (78) counter-clockwise until the sear engager (124) clears the sear face (90), allowing the sear face (90) to move upward into alignment with the sear engager (124). The bowstring (36) may thereafter be released into the string retainer (122) with the sear face (90) holding the sear engager (124) against rotation of the retainer bar (118) and release of the bowstring (36). At this point, even if the trigger (48) is pulled, the lack of an arrow (not shown) along the rail (16) forces a "dry fire" situation. The extension spring (142) pulls the dry fire pin (136) into the dry fire orientation, engaging the recess (146) when the trigger (48) is pulled, thereby preventing the retainer bar (118) from rotating counter-clockwise sufficiently to release the bowstring (36). (FIGS. 2 and 5).

Figure 6:
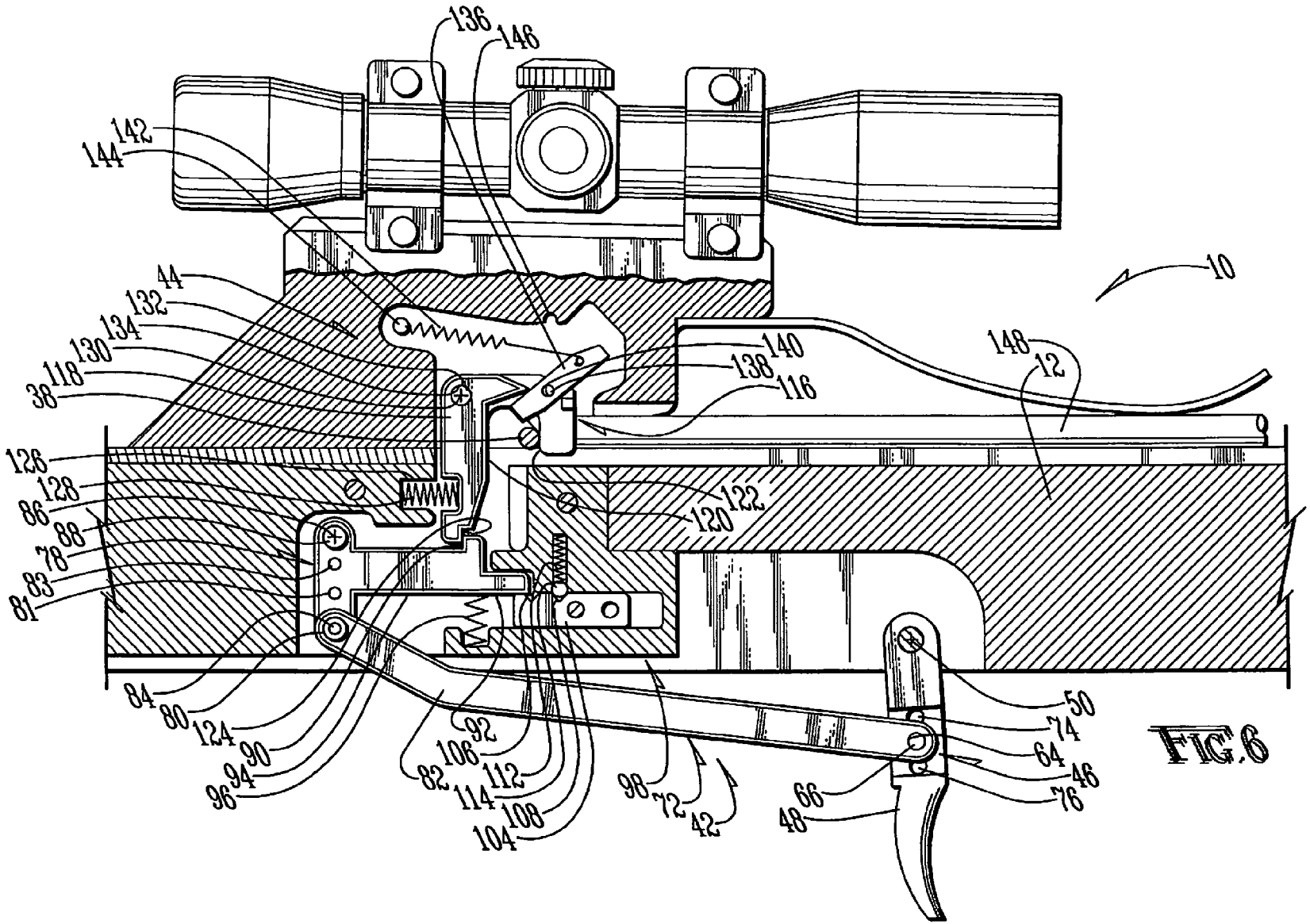
FIG. 6 shows a side elevation in cross-section of the trigger assembly of FIG. 2, shown with an arrow engaging and releasing the dry fire mechanism and the sear engager contacting the sear face with the safety actuated.

As shown in FIG. 6, once the trigger assembly (42) has been cocked as described above, an arrow (148) is positioned along the rail (16) and moved rearward into engagement with the bowstring (36). The arrow (148) also contacts the dry fire pin (136) and rotates the dry fire pin (136) clockwise against the pressure of the extension spring (142), sufficiently to prevent the extension spring (142) from engaging the recess (146) when the trigger (48) is pulled.

Figure 7:
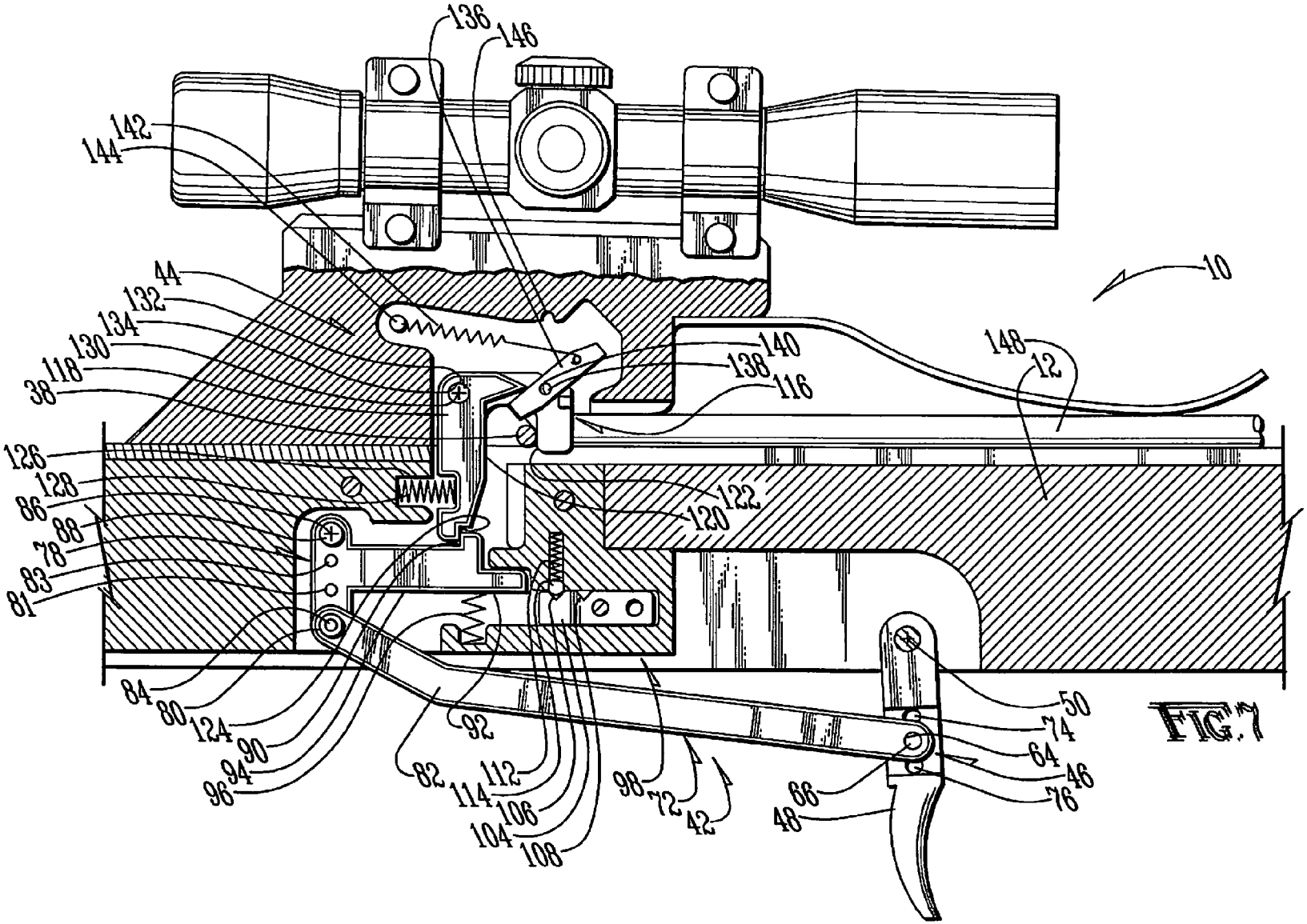
FIG. 7 shows a side elevation in cross-section of the trigger assembly of FIG. 2, shown with the safety released and the trigger assembly ready to fire.

As shown in FIG. 6, prior to insertion of the arrow (148), the safety bar (104) is moved rearward until the ball (114) engages the second detent (108), thereby holding the safety bar (104) in the safe position underneath the safety engager (92) of the sear assembly (78). Accordingly, even if the trigger (48) is pulled, the safety bar (104) prevents the sear assembly (78) from rotating clockwise and releasing the retainer bar (118). Therefore, the bowstring (36) and arrow (148) cannot be released until the safety bar (104) is moved forward into the fire position as shown in FIG. 7.

Figure 8:
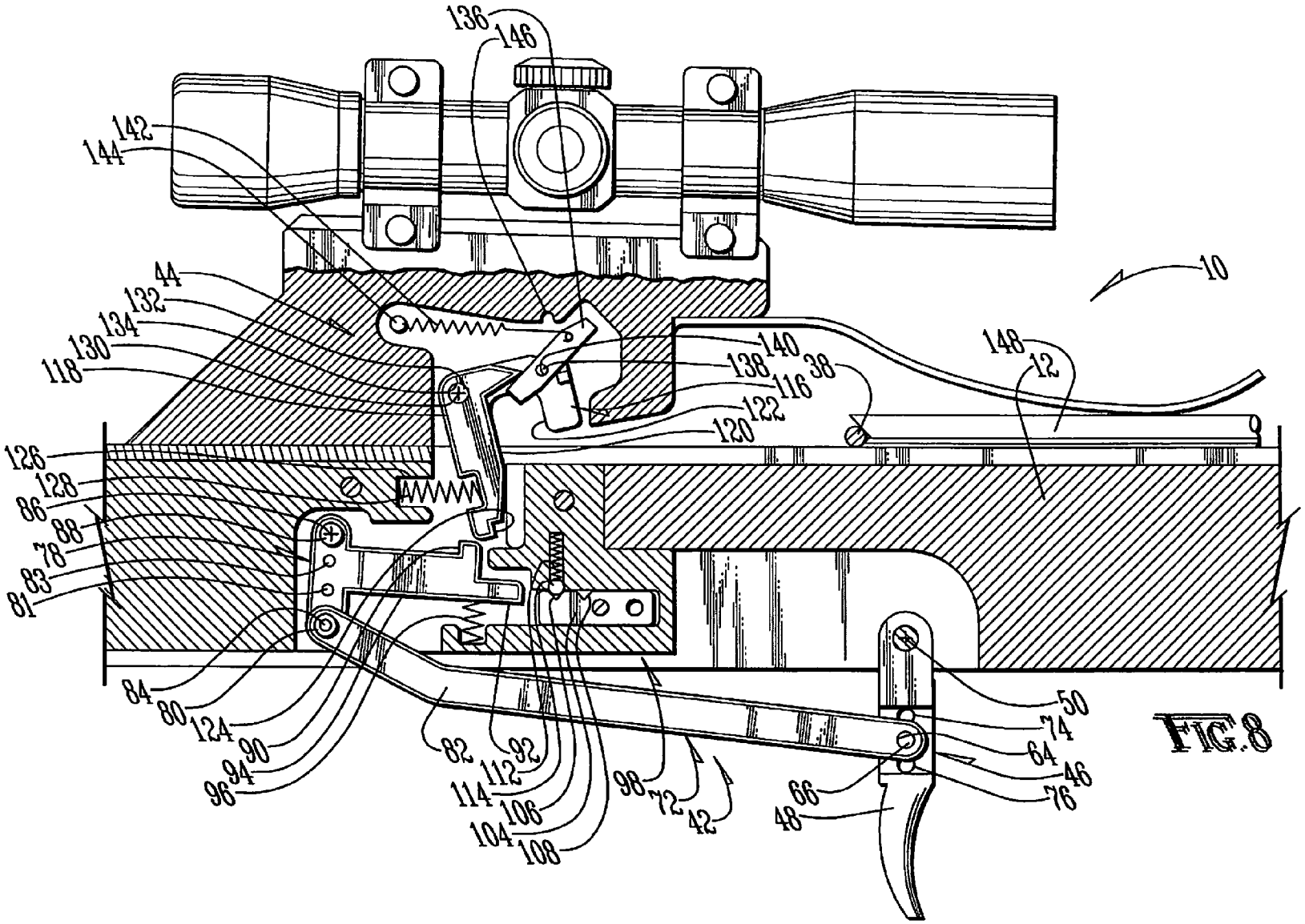
FIG. 8 illustrates a side elevation in cross-section of the trigger assembly of FIG. 2, shown with the trigger actuated, the string released, and the arrow being shot from the crossbow.

Once the safety bar (104) has been moved forward sufficiently so the ball (114) engages the first detent (106), the crossbow (10) may be fired as shown in FIG. 8. Once the trigger (48) is pulled, the trigger (48) moves the trigger arm (72) rearward, causing the sear assembly (78) to rotate clockwise, thereby causing the compression spring (128) to rotate the retainer bar (118) counter-clockwise and release the bowstring (36). Because the arrow (148) is in contact with the dry fire pin (136), the retainer bar (118) pivots counter-clockwise and the bowstring (36) propels the arrow (148) along the rail (16) and away from the crossbow (10) at a high rate of speed.

Although the invention has been described with respect to a preferred embodiment thereof, it is to be understood that it is not to be so limited since changes and modifications can be made therein which are within the full, intended scope of this invention as defined by the appended claims.

The invention claimed is:

1. A trigger assembly comprising:

(a) a frame defining a projectile path;

(b) a trigger bar journaled to said frame;

(c) a trigger provided on said trigger bar;

(d) a trigger arm coupled to said trigger bar;

(e) a sear coupled to said trigger arm wherein said sear comprises:

(i) a sear assembly journaled to said frame at a sear pivot axis;

(ii) wherein said sear assembly is coupled to said trigger arm at a connection point;

(iii) a sear face coupled to said sear assembly between said sear pivot axis and said connection point;

(f) a firing assembly coupled to said sear; and (g) wherein the uppermost point at which said trigger arm is coupled to said trigger bar is below the lowermost point at which said trigger arm is coupled to said sear.

2. The trigger assembly of claim 1, wherein said frame is a crossbow.

3. The trigger assembly of claim 1, further comprising a safety coupled to said sear.

4. The trigger assembly of claim 1, further comprising a safety engager coupled to said sear assembly between said sear pivot axis and said connection point.

5. The trigger assembly of claim 4, further comprising a safety slidably coupled to said safety engager.

6. The trigger assembly of claim 4, further comprising a compression spring coupled to said sear.

7. The trigger assembly of claim 4, further comprising a sear engager coupled to said sear face.

8. The trigger assembly of claim 7, wherein a string retainer assembly is coupled to said sear engager.

9. The trigger assembly of claim 8, wherein said string retainer assembly comprises a U-shaped bar.

10. The trigger assembly of claim 9, wherein said U-shaped bar comprises a string engager and a string retainer.

11. The trigger assembly of claim 8, further comprising a dry fire pin coupled to said U-shaped bar.

12. The trigger assembly of claim 11, further comprising an arrow in contact with said dry fire pin.

13. The trigger assembly of claim 8, further comprising a compression spring coupled to said string retainer assembly.

14. A trigger assembly comprising:

(a) a frame;

(b) a trigger;

(c) a trigger bar coupled to said trigger;

(d) wherein said trigger bar is journaled to said frame;

(e) a sear;

(f) a trigger arm coupled to said trigger bar and pivotably coupled to said sear;

(g) a firing assembly coupled to said sear;

(h) wherein the uppermost point at which said trigger arm is coupled to said trigger bar is below the lowermost point at which said trigger arm is coupled to said sear; and (i) wherein said firing assembly is coupled to said sear at a point rearward of said trigger.

15. The trigger assembly of claim 14, further comprising:

(a) a string coupled to said firing assembly;

(b) an arrow coupled to said string;

(c) a dry fire pin coupled to said firing assembly; and (d) wherein said arrow is in contact with said dry fire pin.

* * * * *